US006435090B2

(12) United States Patent
Saito

(10) Patent No.: US 6,435,090 B2
(45) **Date of Patent: *Aug. 20, 2002**

(54) SHEET RECEIVING APPARATUS IN SHEET-FED ROTARY PRINTING PRESS

(75) Inventor: Nobuaki Saito, Ibaragi (JP)

(73) Assignee: Komori Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/395,113

(22) Filed: Sep. 14, 1999

(30) Foreign Application Priority Data

Sep. 14, 1998 (JP) ..... 10-260111

(51) Int. Cl.[7] ..... B65H 31/32; B65H 31/00; B41F 13/54; B41F 13/64; B41F 13/70

(52) U.S. Cl. ..... 101/407.1; 414/790.8; 271/214

(58) Field of Search ..... 101/407.1; 414/790.8; 271/218, 219, 214

(56) References Cited

U.S. PATENT DOCUMENTS 4,529,190 A 7/1985 Goodwin et al. ..... 271/213
4,538,511 A * 9/1985 Wise ..... 100/7
5,131,647 A * 7/1992 Henn et al. ..... 271/218
5,322,272 A * 6/1994 Benz et al. ..... 271/218
5,338,020 A * 8/1994 Eltner et al. ..... 271/158
5,713,283 A * 2/1998 Eltner et al. ..... 101/232
5,749,571 A * 5/1998 Heiler ..... 271/213
5,797,321 A 8/1998 Shibata ..... 101/246

FOREIGN PATENT DOCUMENTS

| | | |
|---|---|---|
| DE | 605130 | 10/1934 |
| DE | 2301840 | 7/1974 |
| GB | 787623 | 12/1957 |
| GB | 861133 | 2/1961 |
| JP | 63-87469 | 4/1988 |
| JP | 6387469 | 4/1988 |

* cited by examiner

*Primary Examiner*—Daniel J. Colilla
(74) *Attorney, Agent, or Firm*—Blakely Sokoloff & Taylor & Zafman

(57) ABSTRACT

A sheet receiving apparatus in a sheet-fed rotary printing press includes at least one paper receiving bar, an air cylinder, and a moving plate. The paper receiving bar is inserted in a dropping path for a sheet-like printing product to temporarily stop it after printing. The air cylinder moves the paper receiving bar between a wait position and a sheet receiving position. The moving plate supports the paper receiving bar to be movable in a widthwise direction of the printing product.

11 Claims, 8 Drawing Sheets

SHEET RECEIVING APPARATUS IN SHEET-FED ROTARY PRINTING PRESS

BACKGROUND OF THE INVENTION

The present invention relates to a sheet receiving apparatus in a sheet-fed rotary printing press which temporarily receives a sheet as a printing sample from sheets that are printed, conveyed, and delivered onto a pile board.

In a sheet-fed rotary printing press, a sheet printed by a printing unit is gripped and conveyed by the grippers of delivery chains, is released at a convey terminal end, and is dropped onto a pile board and stacked there. In this printing operation, the operator checks from time to time if the density of the ink and water of the delivered printing product is appropriate so defective printing is not performed.

In the conventional checking method, as shown in Japanese Patent Laid-Open No. 63-87469, a plurality of rod-like sheet receiving members are horizontally and quickly moved forward and backward to and from a delivery sheet dropping path to receive a dropping printing product, thereby temporarily stopping the operation of stacking the printing product onto a pile board. While the printing product stacking operation is temporarily stopped, the operator extracts one to three printing products stacked at the top of the pile board and compares them with a regular printing sample.

With a double-sided simultaneous printing product, when the sheet receiver is temporarily moved forward under the lower surface of the printing product to receive it, the lower surface of the printing product where the ink is not dried is brought into slidable contact with the sheet receiver. Therefore, the lower surface of the printing product is soiled by rubbing off of the ink to produce a defective printing product. Then, the defective printing product must be removed from the stacked printing products, which is cumbersome.

SUMMARY OF THE INVENTION

It is an object of the present invention to provide a sheet receiving apparatus in a sheet-fed rotary printing press in which occurrence of a defective printing product is prevented.

It is another object of the present invention to provide a sheet receiving apparatus in a sheet-fed rotary printing press in which the operation of removing a defective printing product is not necessary.

In order to achieve the above objects, according to the present invention, there is provided a sheet receiving apparatus in a sheet-fed rotary printing press, comprising at least one sheet receiving member inserted in a dropping path for a sheet-like printing product to temporarily stop the printing product after printing, drive means for moving the sheet receiving member between a wait position and a sheet receiving position, and a support mechanism for supporting the sheet receiving member to be movable in a widthwise direction of the printing product.

DESCRIPTION OF THE PREFERRED EMBODIMENTS

The present invention will be described in detail with reference to the accompanying drawings.

Figure 1A:
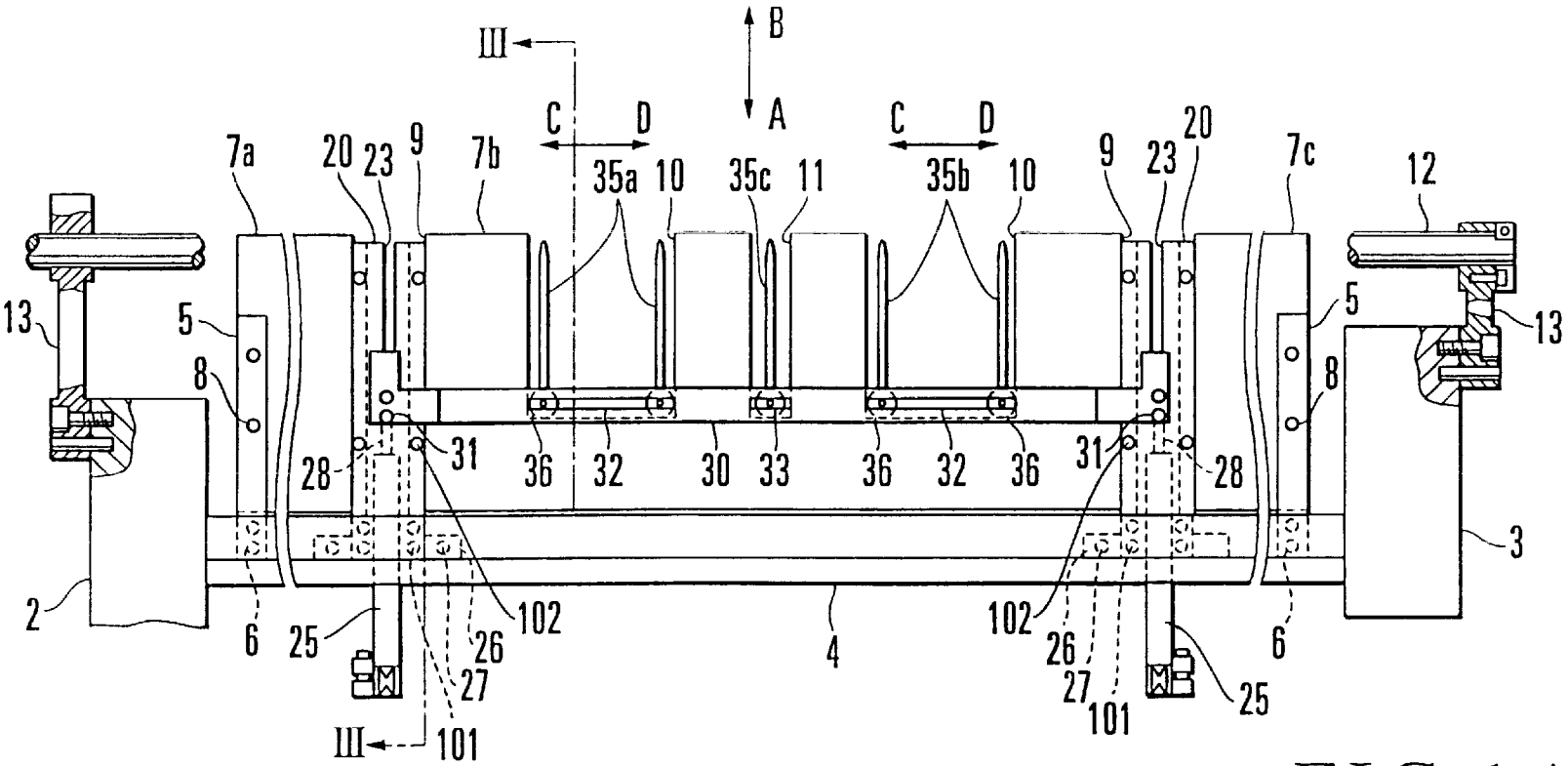
FIG. 1A is a plan view of a sheet receiving apparatus in a sheet-fed rotary printing press according to the first embodiment of the present invention.

FIG. 1A shows a sheet receiving apparatus in a sheet-fed rotary printing press according to an embodiment of the present invention. Referring to FIG. 1A, a stay 4 horizontally extends between a pair of frames 2 and 3 provided to be separate from each other by a predetermined distance. A pair of prismatic supports 5 are attached to the two ends of the stay 4 with bolts 6 to extend in a direction B opposite to a delivery direction A of a printing product.

Figure 4A:
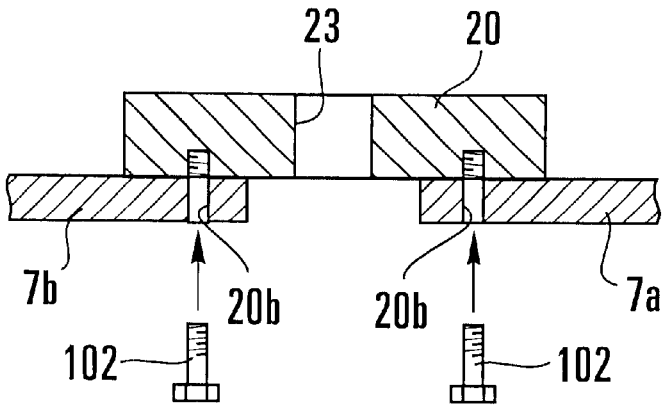
FIG. 4A is a sectional view showing covers and a guide plate fixed to each other.
Figure 4B:
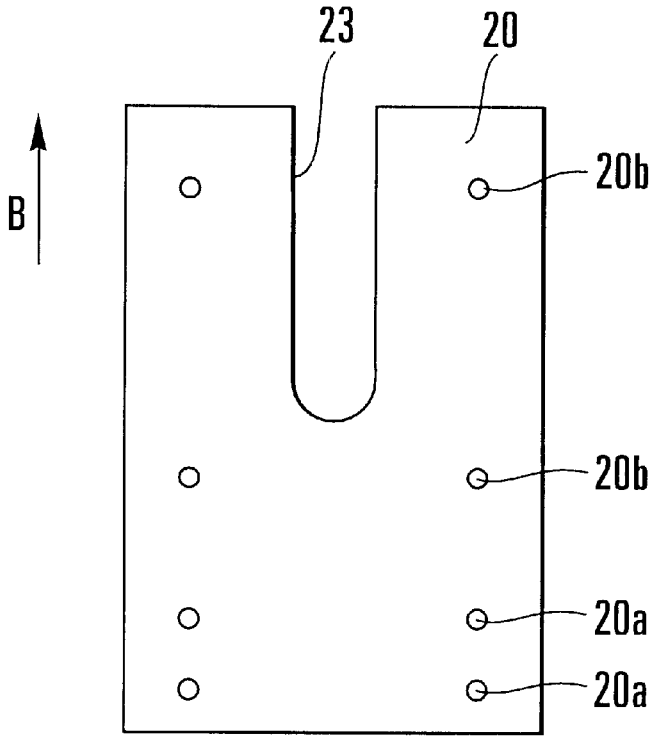
FIG. 4B is an enlarged plan view of the guide plate shown in FIG. 4A.

Flat plate-like covers 7*a*, 7*b*, and 7*c*, which are substantially rectangular when seen from the top, are arranged in series between the frames 2 and 3. One end of each of the covers 7*a* and 7*c* is fixed to the corresponding support 5 through bolts 8. Other-end portions of the covers 7*a* and 7*c* are connected to the two ends of the cover 7*b* through a pair of guide plates 20 fixed to the stay 4. As shown in FIG. 4B, a guide groove 23 which is open in the delivery direction A of the printing product is formed at the central portion of each guide plate 20. A plurality of holes 20*a* and 20*b* are formed in two rows on two sides of the guide plate 20 along the guide groove 23. The covers 7*a* and 7*c*, and 7*b* are fixed to the guide plates 20 with bolts 102 extending through the holes 20*b*.

Each guide plate 20 is attached to the stay 4 with bolts 101 extending through the holes 20*a* such that its one side extending in the counter convey direction (direction indicated by an arrow B) of the printing product is inclined downward. The cover 7*b* is formed with a pair of wide notches 10 and a narrow notch 11 to be parallel to the guide groove 23. The notch 11 is formed at the center of the cover 7*b* between the notches 10. The notches 10 open in the counter delivery direction B of the printing product, in the same manner as the opening of the guide grooves 23.

Figure 2:
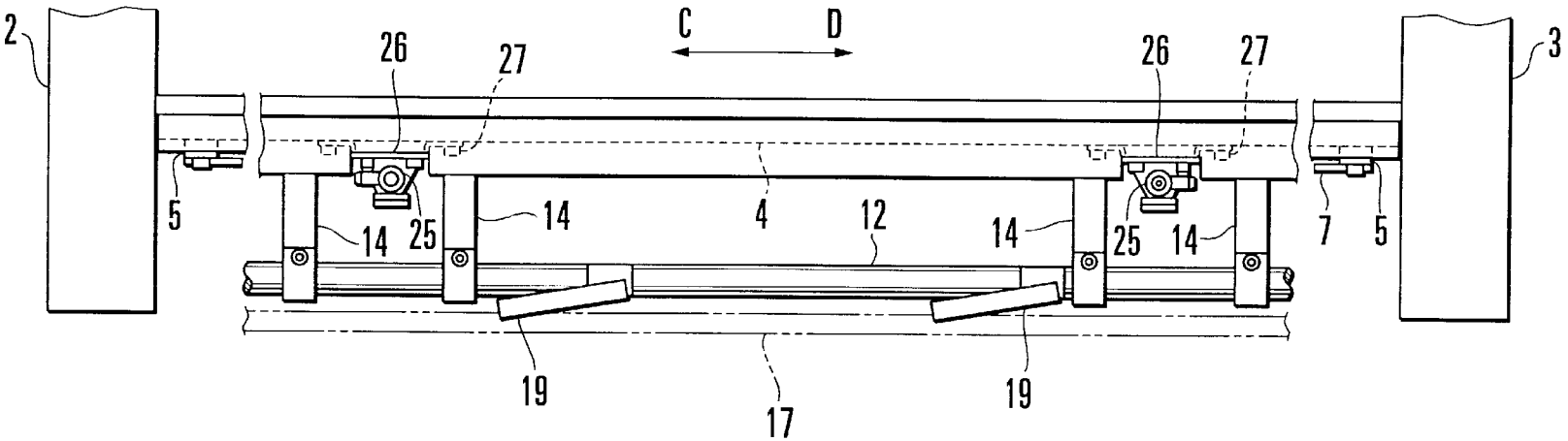
FIG. 2 is a rear view of the sheet receiving apparatus shown in FIG. 1A.
Figure 3:
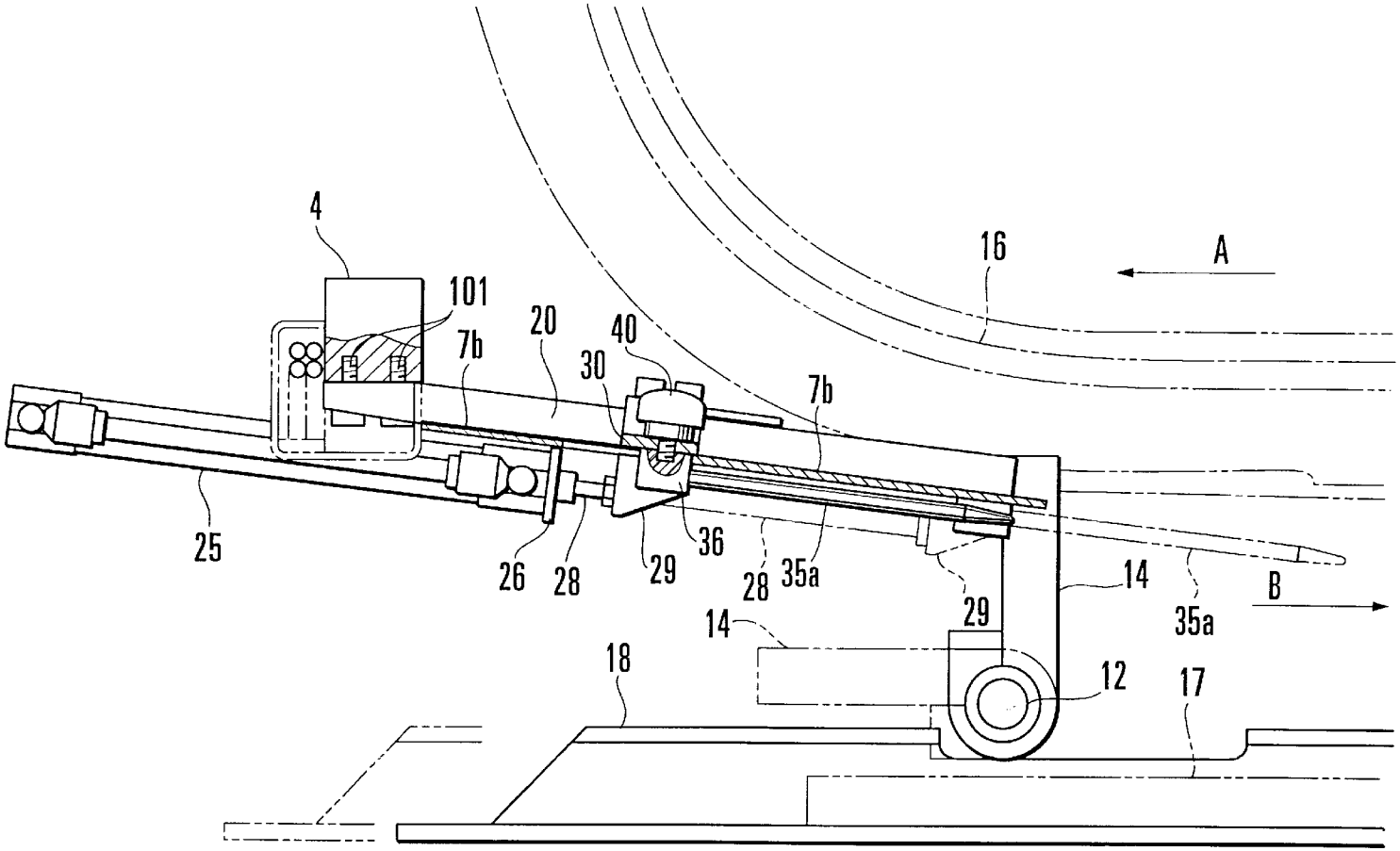
FIG. 3 is an enlarged sectional view taken along the line III—III of FIG. 1A.

A lay shaft 12 is pivotally supported by supports 13 fixed to the frames 2 and 3. As shown in FIG. 2, a plurality of paper lays 14 are fixed to the lay shaft 12 at their proximal ends by split fastening. The lay shaft 12 is driven by an air cylinder (not shown) to pivot such that the paper lays 14 take an upright state indicated by a solid line and a laid state indicated by an alternate long and two short dashed line in FIG. 3. Referring to FIG. 3, a pair of right and left delivery chains (one delivery chain is not shown) 16 travel in a direction of an arrow A. Gripper bars (not shown) extend between the pair of delivery chains 16 at a predetermined pitch. Each gripper bar is provided with a gripper unit composed of a gripper and a gripper pad.

The delivery unit having the above arrangement is disclosed in U.S. Pat. No. 5,797,321.

As the delivery chains 16 travel, a printing product printed by the printing press is conveyed in the direction of arrow A in FIG. 3 as it is gripped by the gripper units. At the convey terminal end, the printing product is released from the gripper units and dropped onto a delivery plate board 17 to be stacked on it. The printing products stacked on the delivery plate board 17 are aligned in the vertical direction by abutting their leading ends against the paper lays 14. A guide 18 guides insertion of the delivery plate board 17. Lay hooks 19 prevent the printing product stacked on the delivery plate board 17 from dropping from the delivery plate board 17.

As shown in FIG. 1A, a pair of air cylinders 25 are attached to the lower surfaces of the guide plates 20, provided between the covers 7*a* and 7*c*, and the cover 7*b*, through brackets 26 with bolts 27. A moving element 29 to engage with the guide groove 23 is attached to the distal end of a rod 28 of each air cylinder 25.

Figure 1B:
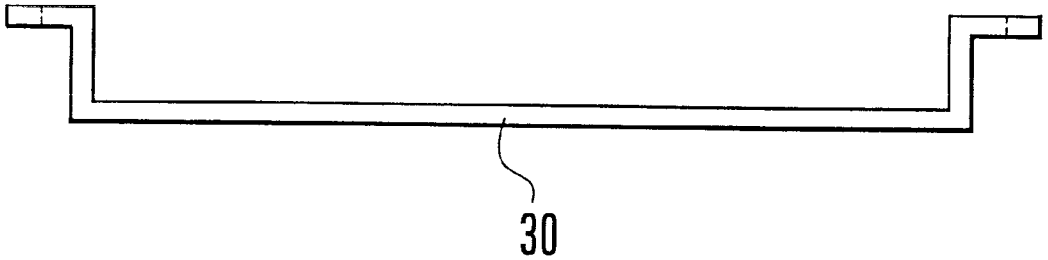
FIG. 1B is a front view of a moving plate shown in FIG. 1A.

The two ends of an elongated moving plate 30 are attached to the moving elements 29 with bolts 31 to extend between the moving elements 29. As shown in FIG. 1B, the two ends of the moving plate 30 are bent in a crank manner. The moving plate 30 is formed with a pair of elongated holes 32 and an elongated hole 33 shorter than the elongated holes 32. The elongated holes 32 extend in a direction (a direction of arrows C–D) perpendicular to the convey direction of the printing product to match the width of the notches 10. The elongated hole 33 matches the width of the notch 11. Round rod-like paper receiving bars 35*a*, 35*b*, and 35*c* are supported by the moving plate 30. Proximal ends 36 of the paper receiving bars 35*a*, 35*b*, and 35*c* movably engage with the elongated holes 32 and 33.

Figure 5A:
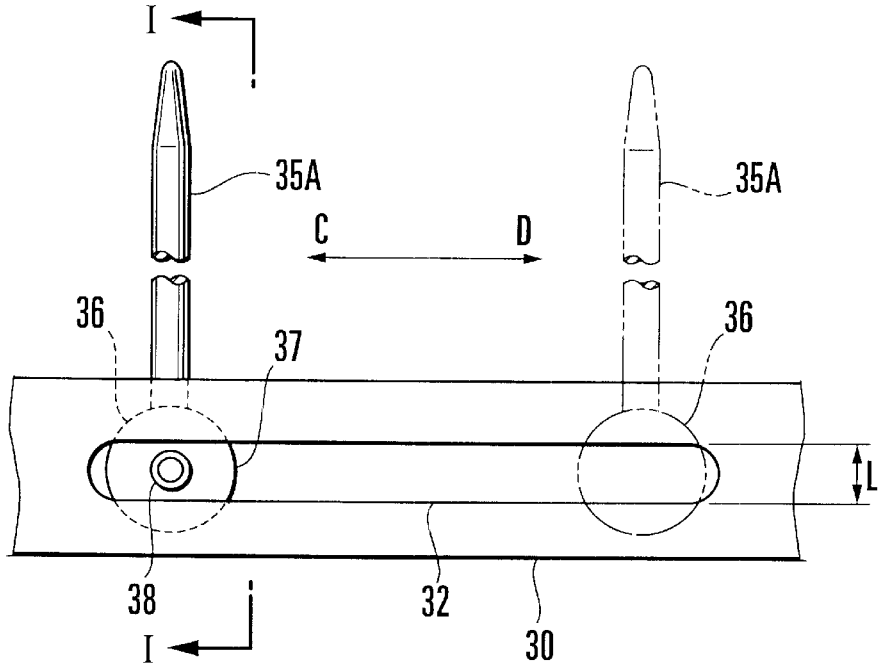
FIG. 5A is an enlarged plan view of a sheet receiving bar mounting portion shown in FIG. 1A.
Figure 5B:
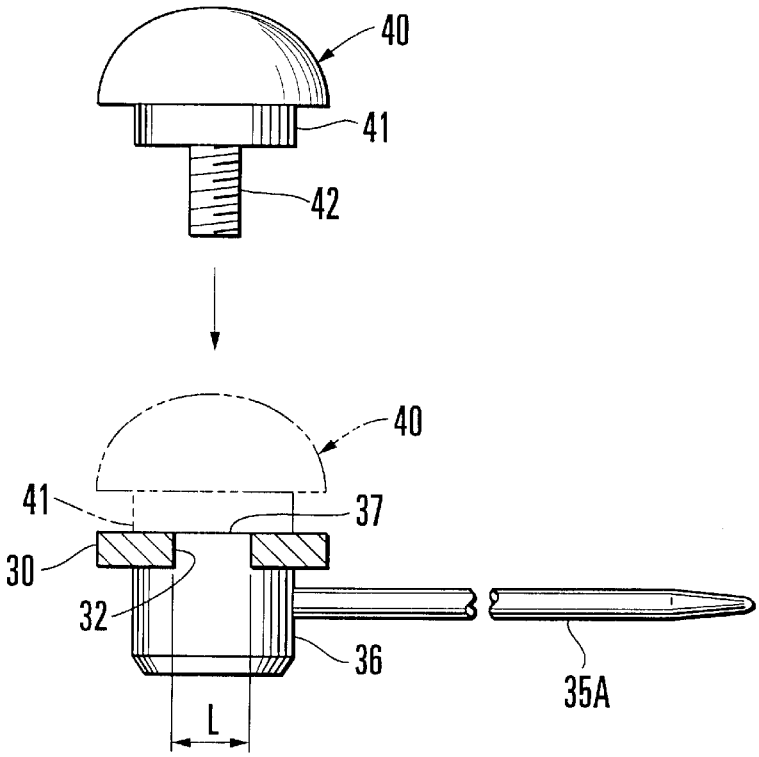
FIG. 5B is a sectional view taken along the line I—I of FIG. 5A.

As shown in FIG. 5C, the proximal ends 36 of the paper receiving bars 35*a*, 35*b*, and 35*c* are cylindrical. The upper end of each proximal end 36 forms a projection 37 which is oval when seen from the top. The projection 37 has a width slightly smaller than a width L of the elongated holes 32 and 33 and a height slightly smaller than the thickness of the moving plate 30. A screw hole 38 is formed at the center of the projection 37, as shown in FIG. 5A. As shown in FIG. 5B, a knob 40 has an abutting portion 41 formed at its lower portion and having substantially the same diameter as that of the proximal end 36. A screw 42 integrally projects from the lower end of the abutting portion 41.

With the paper receiving bars 35*a*, 35*b*, and 35*c* having the above arrangement, the projections 37 of the proximal ends 36 of the paper receiving bars 35*a*, 35*b*, and 35*c* engage in the elongated holes 32 and 33 of the moving plate 30. The screws 42 of the knobs 40 are threadably engaged in the screw holes 38 of the corresponding proximal ends 36 to sandwich the moving plate 30 with the proximal ends 36 and abutting portions 41. The paper receiving bars 35*a* to 35*c* are attached to the moving plate 30 in this manner. The paper receiving bars 35*a* to 35*c* are mounted at positions corresponding to the non-printing areas in accordance with the paper size and plate making, as will be described later.

The temporary sheet receiving operation of the sheet receiving apparatus in the sheet-fed rotary printing press having the above arrangement will be described.

The pair of air cylinders 25 are actuated synchronously to move the respective rods 28 forward in the direction of the arrow B. The moving elements 29 move in the direction of the arrow B as they are guided by the guide grooves 23 of the guide plates 20, so that the moving plate 30 also moves in the direction of the arrow B. Since the three paper receiving bars 35*a* also move in the direction of the arrow B, the sheet released from the gripper units of the delivery chains 16 is placed on the three paper receiving bars 35*a* to 35*c*. Simultaneously, another air cylinder (not shown) is actuated to pivot the lay shaft 12 counterclockwise, as shown in FIG. 3. The paper lays 14 are accordingly set in the laid state indicated by the alternate long and two short dashed line, so the sheet located immediately under the paper receiving bars 35*a* to 35*c* can be extracted from the paper lays 14 as the printing sample.

How the paper receiving bars 35*a* to 35*c* are mounted will be described.

Figure 6A:
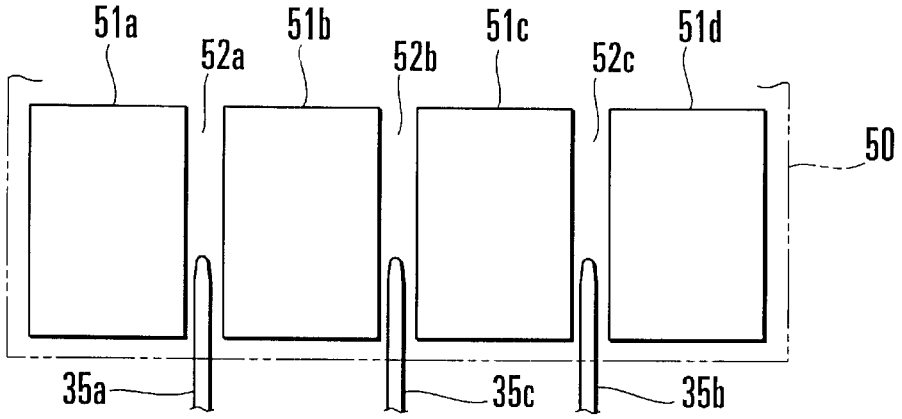
FIGS. 6A, 6B, and 6C are views for explaining the position of the sheet receiving bar with respect to one printing product in four-surface printing, two-surface printing, and three-surface printing, respectively.

As shown in FIG. 6A, when four-surface printing is to be performed for one printing product 50, four image areas 51*a* to 51*d* are arranged to correspond to four image patterns, and the three paper receiving bars 35*a* to 35*c* are positioned on the printing product 50 to correspond to three non-image areas 52*a* to 52*c* among the image areas 51*a* to 51*d*.

Figure 6B:
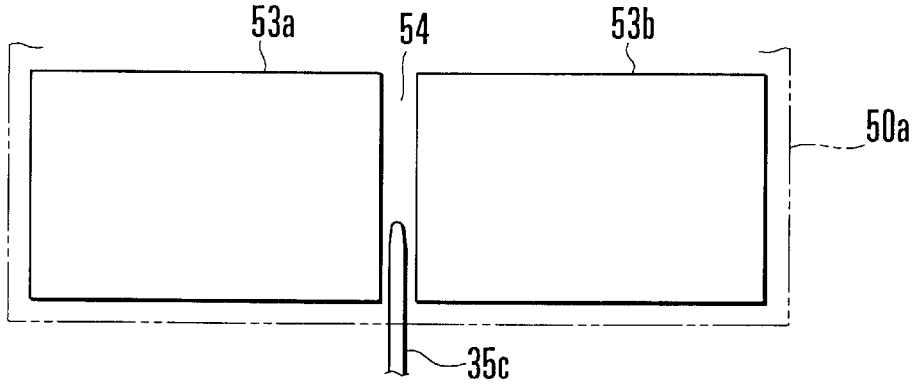

As shown in FIG. 6B, when two-surface printing is to be performed for one printing product 50*a*, two image areas 53*a* and 53*b* are arranged to correspond to two image patterns, and one paper receiving bar 35*c* is positioned to correspond to one non-image area 54 between the image areas 53*a* and 53*b*. In this case, the paper receiving bars 35*a* and 35*b* are removed from the moving plate 30 by rotating the knobs 40 to disengage their screws 42 from the screw holes 38.

Figure 6C:
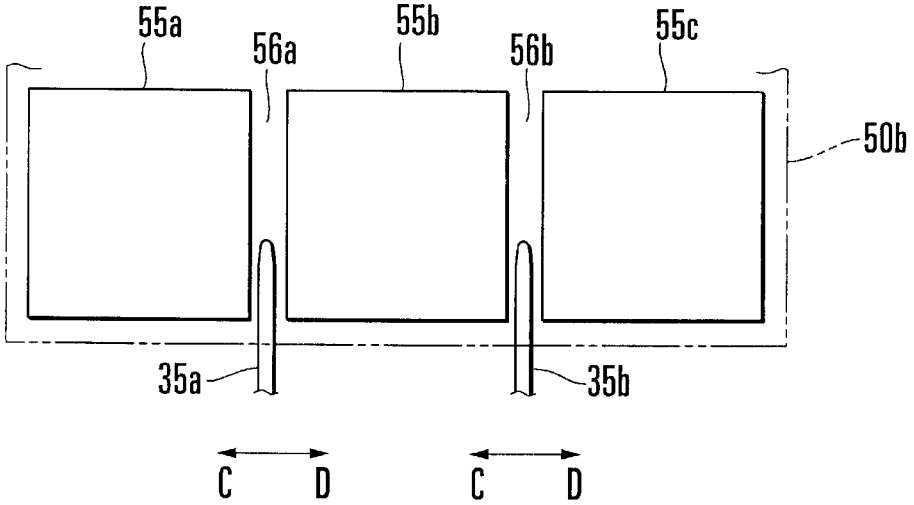

As shown in FIG. 6C, when three-surface printing is to be performed for one printing product 50*b*, three image areas 55*a* to 55*c* are arranged to correspond to three image patterns, and the two paper receiving bars 35*a* and 35*b* are positioned to correspond to two non-image areas 56*a* and 56*b* among the image areas 55*a* to 55*c*. In this case, the paper receiving bar 35*c* is removed from the moving plate 30 in the same manner as described above, and the projections 37 of the proximal ends 36 of the paper receiving bars 35*a* and 35*b* are moved in the widthwise direction (a direction of arrows C–D) of the printing product along the elongated holes 32 by loosening their knobs 40, thereby positioning the paper receiving bars 35*a* and 35*b*. After that, the knobs 40 are rotated to fasten them, so the paper receiving bars 35*a* and 35*b* are fixed.

In this manner, the paper receiving bars 35*a* to 35*c* can be removed from the moving plate 30 or moved in the widthwise direction of the printing product in accordance with changes in plate making for the images of the printing products 50, 50*a*, and 50*b*. Therefore, the paper receiving bars 35*a* to 35*c* can be positioned in the non-image areas.

When the paper receiving bars 35*a* to 35*c* are positioned not to be located in the image areas, contamination of the image areas can be prevented, and occurrence of a defective sheet can accordingly be prevented. The operation of removing a defective sheet becomes unnecessary to reduce the load of inspection. The paper receiving bars 35*a* to 35*c* are moved as they are guided along the elongated holes 32 and 33 formed in the moving plate 30, and are removed by disengaging the screws 42 from the screw holes 38 through rotation of the knobs 40. Therefore, the number of components does not increase, and the structure is simplified.

In the above embodiment, the paper receiving bars 35*a* to 35*c* are moved or removed to cope with changes in plate making for images. Obviously, the paper receiving bars 35*a* to 35*c* may be moved or removed to cope with a change in paper size or position of the image. Although the paper receiving bars 35*a* to 35*c* are moved forward by the air cylinders 25 in the paper delivery direction A, they may be moved in a direction perpendicular to the convey direction A of the printing product to match the direction along which the non-image areas are aligned.

Figure 7:
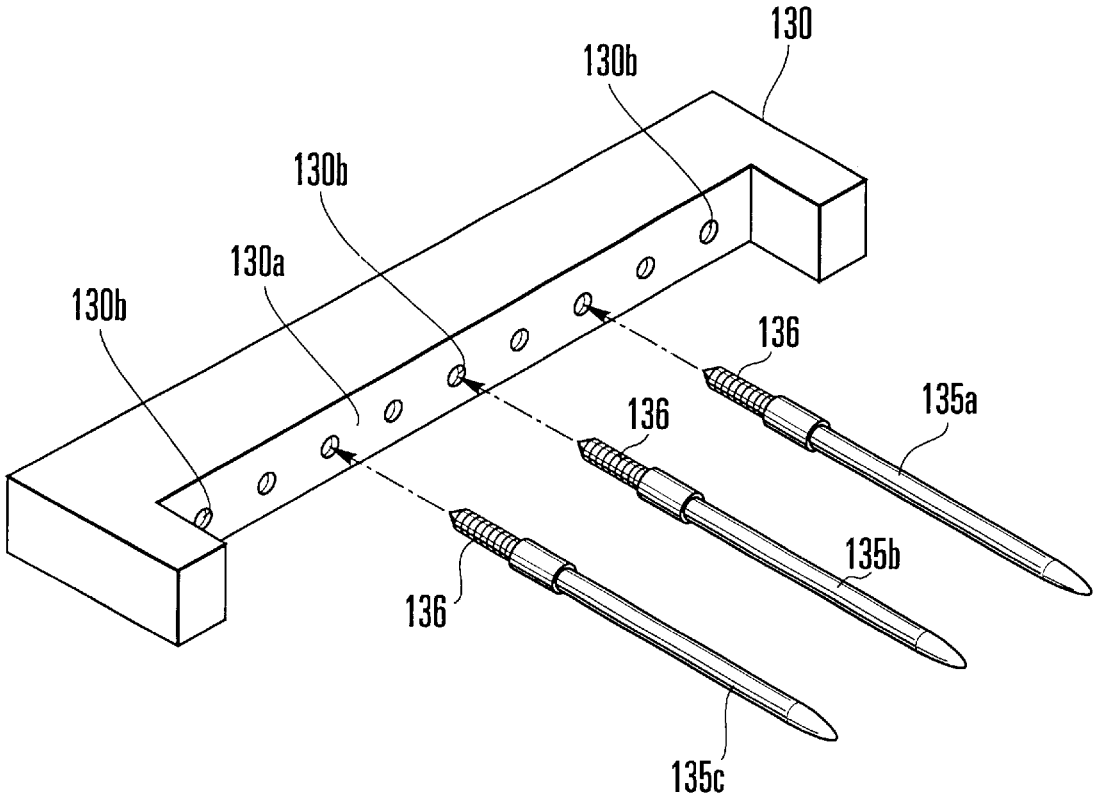
FIG. 7 is a perspective view of a moving plate showing the mounting portions of sheet receiving bars according to the second embodiment of the present invention.

In the above embodiment, the paper receiving bars 135*a* to 135*c* are moved along the elongated holes 32 of the moving plate 30. However, the present invention is not limited to this. For example, as shown in FIG. 7, a plurality of screw holes 130*b* may be formed in a front end face 130*a* of a thick moving plate 130 in its longitudinal direction, and screws 136 may be formed on the bases of paper receiving bars 135*a* to 135*c*. The paper receiving bars 135*a* to 135*c* can be positioned at arbitrary positions by selectively, threadably engaging the screws 136 with the plurality of screw holes 130*b*.

In the above embodiment, three paper receiving bars 135*a* to 135*c* are provided. However, it suffices if at least one paper receiving bar is provided. The covers 7*a* to 7*c* may form one plate. In this case, notches to oppose guide grooves 23 may be formed at positions corresponding to guide plates 20.

As has been described above, according to the present invention, for example, when plate making for the image of the sheet is to be changed, the paper receiving bars can be moved in the widthwise direction of the printing product or can be removed to correspond to the non-image areas. The image areas will not be soiled, and occurrence of a defective sheet can be prevented. The operation of removing a defective sheet becomes unnecessary to reduce the load of inspection. Furthermore, the number of components does not increase, and the structure is simplified.

What is claimed is:

1. A sheet receiving apparatus in a sheet-fed rotary printing press, comprising:

at least one sheet receiving member inserted in a dropping path for a sheet-like printing product to temporarily stop the printing product after printing;

drive means for moving said sheet receiving member in a first direction between a wait position and a sheet receiving position; and a support mechanism for supporting said sheet receiving member after moving said sheet receiving member in a second direction substantially perpendicular to and in a same substantially horizontal plane as the first direction.

2. An apparatus according to claim 1, wherein said sheet receiving member is detachably supported by said support mechanism.

3. An apparatus according to claim 1, wherein said support mechanism comprises:

an elongated member extending in the second direction of the printing product, an elongated hole formed to extend through said elongated member to extend in the second direction of the printing product, and a fixing member for fixing one end of said sheet receiving member movably engaging with said elongated hole to said elongated member.

4. An apparatus according to claim 1, wherein said support mechanism comprises:

an elongated member extending in the second direction of the printing product, a plurality of screw holes formed in one end face of said elongated member and aligned in the second direction of the printing product, and a screw formed on one end of said sheet receiving member to selectively engage with said screw holes.

5. An apparatus according to claim 1, wherein said sheet receiving member comprises a rod-like member.

6. An apparatus according to claim 1, wherein said drive means comprises an air cylinder having a rod that moves forward and backward, and said sheet receiving member moves between the wait position and the sheet receiving position in accordance with a forward/backward movement of said rod.

7. An apparatus according to claim 1, wherein the first direction is a conveying direction of the sheet-like printing product, and the apparatus further comprising different configurations of the support mechanism and sheet receiving member to allow the sheet receiving member to be positioned in different positions along the support mechanism so that the sheet receiving member is positioned between image areas arranged on the sheet-like printing product.

8. A sheet receiving apparatus in a sheet-fed rotary printing press, comprising:

at least one sheet receiving member inserted in a dropping path for a sheet-like printing product to temporarily stop the printing product after printing;

a support mechanism for supporting said sheet receiving member; and drive means for reciprocally driving said support mechanism in a first direction so that said sheet receiving member moves between a wait position and a sheet receiving position while being supported by said support mechanism, wherein said support mechanism supports said sheet receiving member after moving said sheet receiving member in a second direction substantially perpendicular to and in a same substantially horizontal plane as the first direction.

9. A sheet receiving apparatus in a sheet-fed rotary printing press, comprising:

at least one sheet receiving member inserted in a dropping path for a sheet-like printing product to temporarily stop the printing product after printing;

drive means for moving said sheet receiving member in a first direction between a wait position and a sheet receiving position; and a support mechanism for supporting said sheet receiving member in a second direction substantially perpendicular to the first direction, the second direction also parallel to a face of the sheet-like printing product.

10. A sheet receiving apparatus in a sheet-fed rotary printing press, comprising:

at least one sheet receiving member inserted in a dropping path for a sheet-like printing product to temporarily stop the printing product after printing;

drive means for moving said sheet receiving member in a first direction between a wait position and a sheet receiving position; and a support mechanism for supporting said sheet receiving member in a second direction substantially perpendicular to a normal direction extending from a face of the sheet-like printing product and to the first direction.

11. A sheet receiving apparatus in a sheet-fed rotary printing press, comprising:

at least one sheet receiving member inserted in a dropping path for a sheet-like printing product to temporarily stop the printing product after printing;

drive means for moving said sheet receiving member in a first direction between a wait position and a sheet receiving position; and a support mechanism for supporting said sheet receiving member in a second direction substantially perpendicular to the first direction, wherein the sheet-like printing product has a first side substantially parallel to the first direction and a second side that is substantially perpendicular to the first side such that the second direction is parallel with the second side.

* * * * *